US005269857A

United States Patent [19]

Ganesh et al.

[11] Patent Number: 5,269,857

[45] Date of Patent: Dec. 14, 1993

[54] MINIMIZATION OF QUENCH CRACKING OF SUPERALLOYS

[75] Inventors: Swami Ganesh, West Chester; William R. Butts, Milford; Raymond D. Rife, Cincinnati; Thomas J. Tomlinson, West Chester, all of Ohio

[73] Assignee: General Electric Company, Cincinnati, Ohio

[21] Appl. No.: 860,836

[22] Filed: Mar. 31, 1992

[51] Int. Cl.[5] ..... B23K 20/00; B23K 3/00; C22C 19/00

[52] U.S. Cl. ..... 148/675; 148/410; 148/676; 428/680

[58] Field of Search ..... 148/675, 676, 410; 428/680

[56] References Cited

U.S. PATENT DOCUMENTS

| | | | |
|---|---|---|---|
| 4,531,981 | 7/1985 | Singer | 148/675 |
| 4,654,091 | 3/1987 | Malley | 148/518 |
| 4,743,514 | 5/1988 | Strangman et al. | 428/680 |
| 4,816,084 | 3/1989 | Chang | 148/675 |
| 4,820,353 | 4/1989 | Chang | 148/675 |
| 4,854,906 | 8/1989 | Livshultz et al. | 148/675 |
| 4,867,812 | 9/1989 | Henry | 148/410 |
| 4,919,323 | 4/1990 | Mahoney et al. | 228/193 |
| 5,025,975 | 6/1991 | Oakes et al. | 228/193 |
| 5,077,090 | 12/1991 | Sawyer | 427/404 |
| 5,100,050 | 3/1992 | Krueger et al. | 228/193 |

*Primary Examiner*—Upendra Roy
*Attorney, Agent, or Firm*—Jerome C. Squillaro; Carmen Santa Maria

[57] ABSTRACT

A method for preparing a heat-treated article made of a superalloy, such as a turbine disk preform, includes furnishing an article made of a superalloy that is prone to quench cracking, usually after forging the article, and thereafter covering at least a portion of the article with a quench cladding having a thickness of at least about ⅛ inch so that the quench cladding is in direct thermal contact with the article. The quench cladding may be conveniently applied to the article by thermal spraying, which produces direct thermal contact between the quench cladding and the article, or by placing the article into the envelope of the quench cladding material and hot isostatically pressing to achieve a direct thermal contact between the envelope and the article. After the quench cladding is in place, the clad article is heated to elevated temperature and quenched from the elevated temperature to a lower temperature, and the envelope is removed. By reducing the thermal gradient at the surface of the article and by reducing the oxidation embrittlement of the surface of the article, the quench cladding aids in reducing the incidence and severity of quench cracks. The quench cladding may be applied over the entire surface of the article, or only over the most crack-prone regions.

20 Claims, 3 Drawing Sheets

MINIMIZATION OF QUENCH CRACKING OF SUPERALLOYS

BACKGROUND OF THE INVENTION

This invention relates to the manufacturing technology of superalloys, and, more particularly, to the prevention or reduction of quench cracking of superalloys that are quenched during their processing.

Superalloys are metallic alloys developed for high-temperature service under extreme conditions including high loading, fatigue, thermal gradients, oxidation, and corrosion. The commercially most important of the superalloys are nickel-base and cobalt-base alloys used in aircraft gas turbine applications. Such superalloys are used in cast parts such as turbine blades and vanes, and in wrought parts such as turbine disks. The present invention relates to the manufacturing technology of wrought superalloys.

A wrought article is usually prepared by furnishing a blank of the superalloy material, and deforming the blank by a metal-working process such as forging to form a preform. In most cases, the preform is thereafter heated to elevated temperature to attain a particular microstructure and then cooled rapidly ("quenched") to lower temperature to retain that structure. The article is then reheated to a lower temperature.

Some of the most important and most advanced superalloys are prone to cracking during the quenching operation. Such behavior is generally known as quench cracking. Quench cracks appear at the surface of the article, either throughout the surface or at crack-prone regions. Quench cracks are of great concern. If allowed to remain on the article, the quench cracks can eventually lead to premature failure of the article, usually by fatigue crack propagation from the quench cracks. Quench cracking of wrought superalloys is therefore a problem of great concern in aircraft gas turbine manufacturing.

It is difficult to predict which superalloys will be prone to quench cracking, or the extent to which any particular superalloy may quench crack during processing. Generally, however, if a superalloy article of a particular configuration exhibits quench cracks after being processed in an otherwise desirable manufacturing sequence, it is said to be prone to quench cracks.

The propensity for quench cracking is influenced by many variables, including the composition of the alloy, its microstructure, its mechanical and physical properties, the quenching medium, the temperature from which the material is quenched, part size and configuration, especially such design factors as sharp corners and abrupt changes in section size. For example, a particular superalloy may exhibit quench cracks when quenched in water or oil, but not when quenched in moving air. If the manufacturing operation requires an air quench to achieve a desired microstructure of the article, then this particular superalloy would not be prone to quench cracking. On the other hand, if the manufacturing operation requires a water or oil quench to achieve a desired microstructure, this superalloy would be prone to quench cracking. If the quenching rate is sufficiently high, then virtually any superalloy could exhibit quench cracking. Similarly, a particular superalloy formed into one shape may exhibit quench cracking, but not when formed into a different shape.

Thus, those skilled in the art of wrought superalloy manufacturing technology recognize which superalloys are prone to quench cracking in various situations, usually by observing quench cracking under particular conditions. Stronger, less ductile alloys usually show the greatest inclination to quench cracking. Some of the advanced superalloys especially developed for service at high temperatures contain large amounts of gamma prime, and are particularly susceptible to quench cracking. An example of a superalloy that is prone to quench cracking when solutioned above the gamma-prime solvus temperature is Rene'95, which has a nominal composition, in weight percent, of 14% Cr, 8% Co, 3.5% Mo, 3.5% W, 3.5% Nb, 2.5% Ti, 3.5% Al, 0.15% C, 0.01% B, 0.05% Zr, balance Ni and incidental impurities.

There is therefore a need for an improved approach in wrought superalloy manufacturing technology to avoid or at least minimize quench cracking.

SUMMARY OF THE INVENTION

The present invention provides a manufacturing technique that reduces or avoids quench cracking in superalloys prone to such cracking, and articles made by that technique. The approach of the invention can be utilized with any superalloy, and does not depend upon modifications to alloy composition or the heat-treatment process. It is therefore possible to process conventional alloys with conventional thermal processing, while minimizing quench cracking. Superalloy articles processed by the present approach can be finished to their final form by conventional techniques.

In accordance with the invention, a method for preparing a heat-treated article made of a superalloy comprises the steps of furnishing an article made of a superalloy that is prone to quench cracking and covering at least a portion of the article with a quench cladding having sufficient thickness, in a way so that the quench cladding is in direct thermal contact with the article. The method further includes heating the clad article to elevated temperature, and quenching the clad article from the elevated temperature to a lower temperature.

The term "sufficient thickness", as used herein in reference to the thickness of a quench cladding, is vital to the present invention. For the reasons of cost and convenience in manufacturing, it is desirable to keep the thickness of a quench cladding to a minimum. However, it is essential that a quench cladding be thick enough to substantially eliminate quench cracking in a particular situation. One skilled in the art of superalloys recognizes that there are many factors, and innumerable combinations of such factors, which determine, in a particular situation, the impact of quench cracking on manufacturing, and whether it represents a problem, and if so, how severe the problem may be. These factors include, but are not limited to, the composition of the superalloy, its microstructure, its mechanical and physical properties, the composition of the quench cladding, the quenching medium, the temperature from which the material is quenched, any delay in the quenching process, and part size and configuration, especially such design factors as sharp corners and abrupt changes in section size. After considering these and other factors, one can determine the minimum thickness of quench cladding which will substantially eliminate quench cracking in that particular situation. "Sufficient thickness" is that minimum thickness which substantially eliminates quench cracking in that situation. The term specifically includes variations in quench cladding thickness at various locations on the surface of the article being quenched.

The quench cladding protects the article from high surface thermal gradients, and also protects it from embrittlement by oxygen at elevated temperatures. A thin layer would be sufficient to protect against the embrittlement, but a thicker layer is required to reduce the surface thermal gradient to an acceptable level. A variety of materials can be used as the quench cladding, but iron-base and nickel-base alloys are preferred. A variety of techniques can be used to cover the surface of the article being protected with the quench cladding, and the choice of a technique will depend upon whether the entire surface or a portion of the surface is to be covered, and the economics of the process. The article to be protected may be a dual alloy disk, in which the bore and the rim are made of different superalloys selected to optimize the properties of the disk at the bore and rim. In such a situation, the bore or the rim or both may be susceptible to quench cracking, or may require different quench rates to achieve the desired microstructure in the specified location, and the use of quench cladding may be necessary for proper processing.

The present invention provides an important advance in the art of superalloy manufacturing technology. As an example, articles such as high strength turbine disk forgings may be prepared from superalloys that could not be previously used because of quench cracking during heat treatment processing.

These and other objects of the invention and the manner in which they can be attained will become apparent from the following detailed description and drawings.

DETAILED DESCRIPTION OF THE INVENTION

Figure 1:
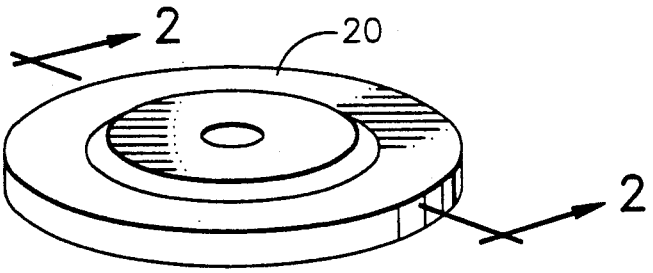
FIG. 1 is a perspective view of a forged turbine disk preform without a quench cladding.

FIG. 1 is a perspective view of a forged turbine disk preform 20. The preform 20 generally has a disk-like shape, and is forged from a blank. There are some structural details on the surface of the preform 20, but these are not pertinent to the present invention.

Figure 2:
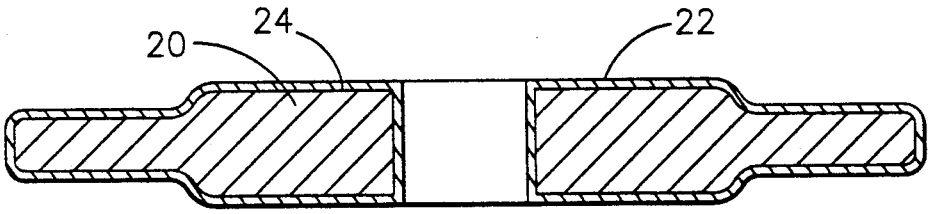
FIG. 2 is an enlarged sectional view of the disk preform of FIG. 1, taken along lines 2—2, with a quench cladding around the entire preform.

A sectional view of the preform 20 is shown in FIG. 2, with a quench cladding 22 applied over the entire surface of the preform 20. The quench cladding 22 is a layer of a ductile metal, preferably a nickel-base alloy or an iron-base alloy such as a stainless steel. The quench cladding 22 has at least a sufficient thickness. Determination of the sufficient thickness may be done by calculation, or by empirical observation.

The present approach is founded on the discovery that the quench cracking of susceptible superalloys during processing is due to two basic causes. First, the thermal gradient at the surface of the article during quenching is very high, producing high thermally induced stresses and strains at the surface. Second, the exposure of the surface of the article to air at elevated temperatures embrittles the surface regions, inhibiting their ability to deform to accommodate the thermally induced stresses and strains. The result of the combination of these effects is quench cracking during processing of the superalloy.

It has been known to plate a thin layer, about 0.015 inches thick, on the surface of superalloys to act as a diffusion barrier to oxygen at elevated temperature. See U.S. Pat. No. 4,654,091. Although this approach of a very thin surface layer may alleviate the embrittlement of the surface due to elevated temperature exposure in air, it does not substantially reduce the thermal gradient at the surface. According to the present approach, the quench cladding must be of sufficient thickness to provide the reduction in the thermal gradient at the surface of the article being quenched necessary to avoid quench cracking. As indicated herein, there is a particular sufficient thickness for each particular situation. However, a thick cladding in the range of 1/16 inch or thicker may be required, as distinct from a thin plated layer. It has been demonstrated empirically and analytically that substantially thinner layers are inoperable to reduce the quench cracking.

Figure 3:
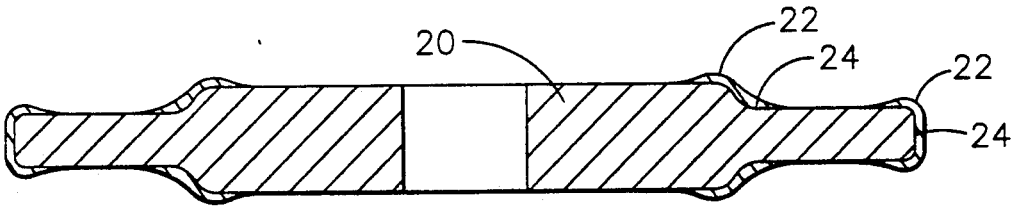
FIG. 3 is a enlarged sectional view like that of FIG. 2, with a quench cladding only at selected areas.

The quench cladding may be applied over the entire surface of the article, as shown in FIG. 2, or over limited areas that are known to be particularly susceptible to quench cracking, as shown in FIG. 3. The approach of FIG. 2 would normally be used where the superalloy of the preform 20 is highly susceptible to quench cracking, and such cracking might occur at any surface location. The quench cladding over the entire surface tends to suppress the quench cracking over the entire surface.

In other situations, particularly where the superalloy is less susceptible to quench cracking, it may be sufficient to provide the quench cladding only in the regions most likely to experience quench cracks. FIG. 3 illustrates the placement of the quench cladding 22 only over certain regions of the surface of the preform 20 that are, by experience, known to be the most prone to quench cracking. Depending upon the size and configuration of the article being protected with a quench cladding, it may be less costly to use a full-surface quench cladding as in FIG. 2 or a partial-surface quench cladding as in FIG. 3.

Whichever approach is followed, it is important that there be at least direct mechanical contact between the article being protected, so that there is good thermal conductivity between the article and the quench cladding, here the preform 20, and the quench cladding 22, along all protected surfaces 24 of the preform 20. A direct thermal contact is a sufficiently close contact that heat flows from the preform 20 through the quench cladding 22 and into the quench medium during the quenching operation. If, for example, there were a significant gap or air space between the article and the quench cladding at a portion of the surface 24, the heat flow out of the article during quenching would be distorted and the heat flow rate reduced, leading to insufficiently rapid quenching of the article in that region. Stated alternatively, when properly utilized the present approach provides an intermediate quench rate at the surface of the article, so that the quench rate is sufficiently high to achieve the desired microstructure but sufficiently low to avoid the quench cracking. If there is not a direct thermal contact at the surface 24 between the article and the quench cladding, the heat flow rate will be insufficient to attain the desired microstructure.

Figure 4:
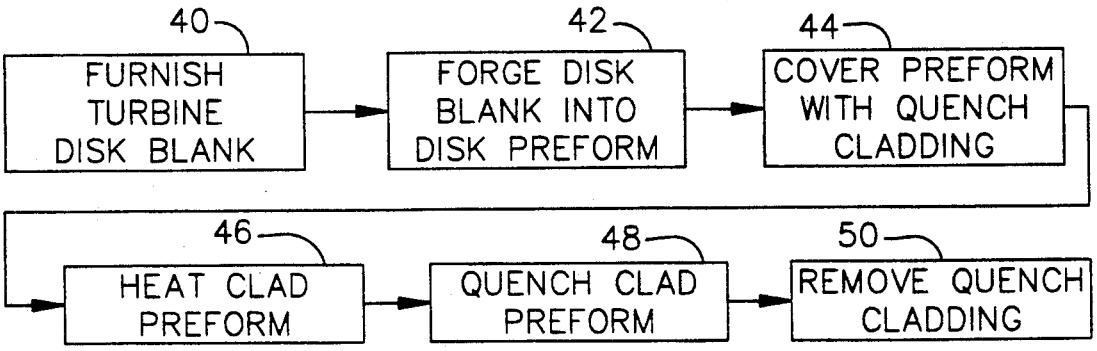
FIG. 4 is a block diagram of the present approach.

FIG. 4 depicts in block diagram form the method of preparing a heat-treated turbine disk preform according to the invention, as a preferred embodiment. There is furnished, numeral 40, a turbine disk blank made of a nickel-base superalloy that is prone to quench cracking. The blank is typically a billet that is larger than required for the final turbine disk, so that portions may be machined away (after the processing described herein) to form various details. The blank is mechanically worked, usually by forging, into the turbine disk preform 22 as shown in FIGS. 1-3.

At least a portion of the preform is then covered with the quench cladding 22 having a sufficient thickness. The quench cladding must be in direct thermal contact with the article, numeral 44. As discussed previously, all or part of the surface of the preform 20 may be covered with the quench cladding 22, as might be appropriate in a particular circumstance.

The quench cladding 22 may be applied by any suitable process, as determined by economics and technical requirements, but a few guidelines are applicable. Where the quench cladding 22 is to be applied over the entire surface of the article and the article has a simple shape, the quench cladding may be conveniently provided as a metallic envelope. In this approach, an envelope formed of one or more sheets of the cladding material is prepared, and the article is placed into the envelope. Equivalently, the sheets of the cladding material may be welded as a "can" over the article to be protected. After the article is thus placed into the envelope, the envelope is collapsed onto the article to place it into direct thermal contact with the surface of the article, using a process such as hot isothermal pressing.

In other circumstances the quench cladding is to be applied over limited areas of the article or over the entire article in some instances such as an article of more complex shape. In these cases, the quench cladding may be conveniently applied over a suitably prepared surface by a thermal spray process, which produces a direct thermal contact between the quench cladding and the article. In a thermal spray process such as arc spraying, high velocity oxy-fuel spraying, low velocity combustion,, plasma spraying, or low pressure plasma spraying, the metal to be deposited as the quench cladding is furnished in the form of a wire or powder, depending on the process selected. The metal is fed into an arc, combustion region, plasma, or other region which at least partially melts the metal feed stock and propels the droplets thereof toward a substrate, in this case the surface of the article being protected. These thermal spray techniques are implemented with a gun-like device, so that the molten spray can be conveniently directed toward local areas of the surface of the article, if desired. It may be desirable to hot isostatically press the quench cladding when applied by a thermal spray process, to consolidate the cladding layer and to ensure a direct thermal contact of the quench cladding to the article substrate.

The operational details of the canning of metal parts inside an envelope and thermal spray techniques are well known in other contexts. In any case, a close thermal contact between the article and the quench cladding is important, because it ensures that a sufficiently high quench rate is attained for the heat treatment, and ensures that the highest thermal gradients will be present at the surface of the quench cladding.

After the quench cladding is in place, the clad preform is heat treated in the desired manner. The heat treatment involves heating the clad preform to elevated temperature, numeral 46, where it is allowed to equilibrate to a desired microstructure. The clad preform is then quenched, numeral 48, from the elevated temperature to a lower temperature, by any of the techniques conventionally used in quenching. Immersion in oil, water or circulating air may be used, for example, to achieve different rates of cooling. The details of the heat treatment procedure are specific to the article and superalloy being treated, and are known in the art. The present invention is operable with all such heat treatment procedures.

In some situations it may be preferable to apply the quench cladding to a billet prior to forging, interchanging the sequence of steps 42 and 44 in FIG. 4. One advantage of this approach is that the quench cladding is intimately bonded to the article during the forging process, thereby achieving positive thermal contact between the article and the quench cladding.

The purpose of the quench cladding is to suppress or prevent quench cracking of the article being manufactured during the quenching operation, and is successful for the reasons discussed previously. After the quenching step is complete, the quench cladding 22 is no longer needed, and can be removed from the clad preform, numeral 50. Removal of the quench cladding is most readily accomplished by machining. The quench cladding may be removed prior to other heat treating and final machining operations, or after they are complete.

EXAMPLE 1

The present approach has been comparatively tested against the conventional approach using disk specimens in two different sizes, about 2.5 inches in diameter and 0.5-1.0 inches thick, and about 9 inches in diameter and 4 inches thick. They were made from a superalloy prone to quench cracking, having a nominal composition, in weight percent, of 10% Cr, 15% Co, 3% Mo, 2.3% Nb, 4.9% Al, 2% Ti, 4.7% Ta, 1% V, balance Ni and incidental impurities.

A control specimen had no quench cladding. A quench cladding of an alloy of 95 percent by weight nickel and 5 percent by weight aluminum was applied over the entire surface of another specimen to a thickness of about 0.190 inches by a conventional arc spray process. Each specimen was heated to 2100° F. in a simulated heat treatment, and then quenched in water. The unclad control specimen exhibited a widespread pattern of surface cracks extending inwardly from the broad surface to a depth of ¼ inch or more. The clad specimen exhibited no surface cracking.

Similar testing was performed using a quench cladding of type 316 stainless steel, with the same results.

Further testing was pursued in which the thickness of the quench cladding was reduced to about 1/16 inch (about 0.062 inch). This thickness of quench cladding was insufficient to suppress quench cracking at the surface of the specimen, and such cracking was observed. However, this alloy is known to highly susceptible to quench cracking.

Several of the larger specimens were provided with quench cladding of about ⅛ inch (about 0.125 inch). These were quenched without cracking.

EXAMPLE 2

The present approach was also comparatively tested against the conventional approach using disk specimens of about 9 inches diameter and 4 inches thickness. They were made from another superalloy prone to quench cracking, having a nominal composition, in weight percent, of 10% Cr, 15% Co, 3% Mo, 1.4% Nb, 5.5% Al, 2.2% Ti, 2.7% Ta, 1% V, 0.03% B, 0.05% C, 0.05% Zr, balance Ni and incidental impurities.

Figure 5B:
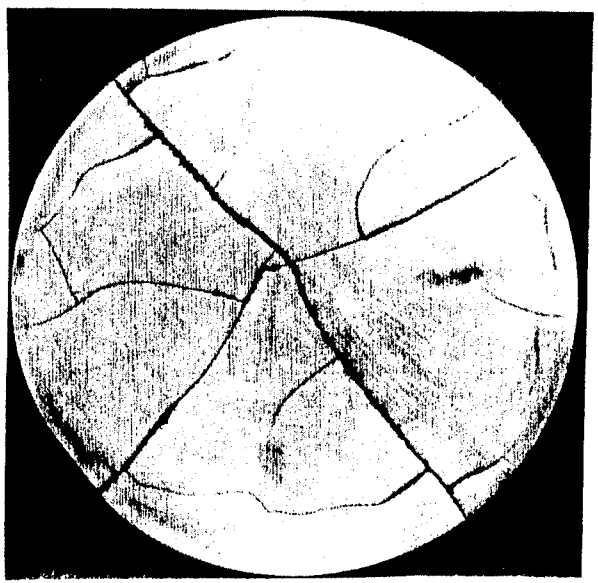
FIG. 5 is a photograph of the face of the disk of Example 2 that was quenched without quench cladding.
Figure 5A:
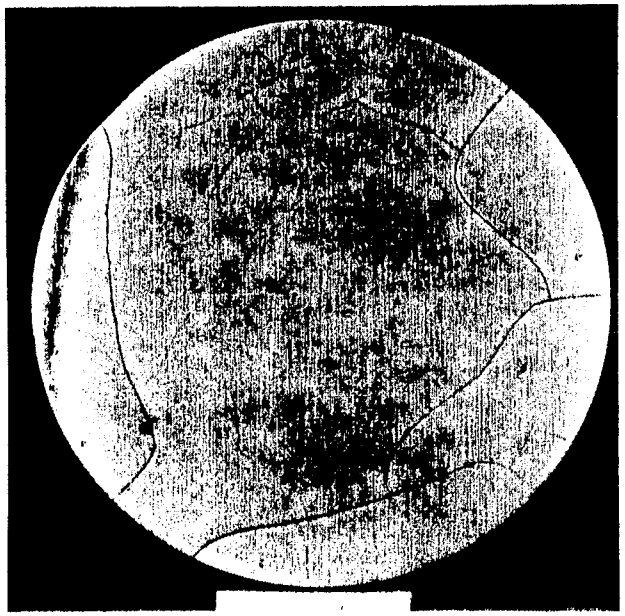
Figure 5C:
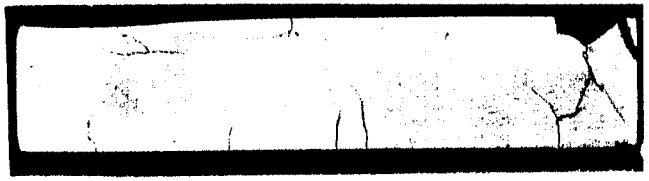
Figure 6:
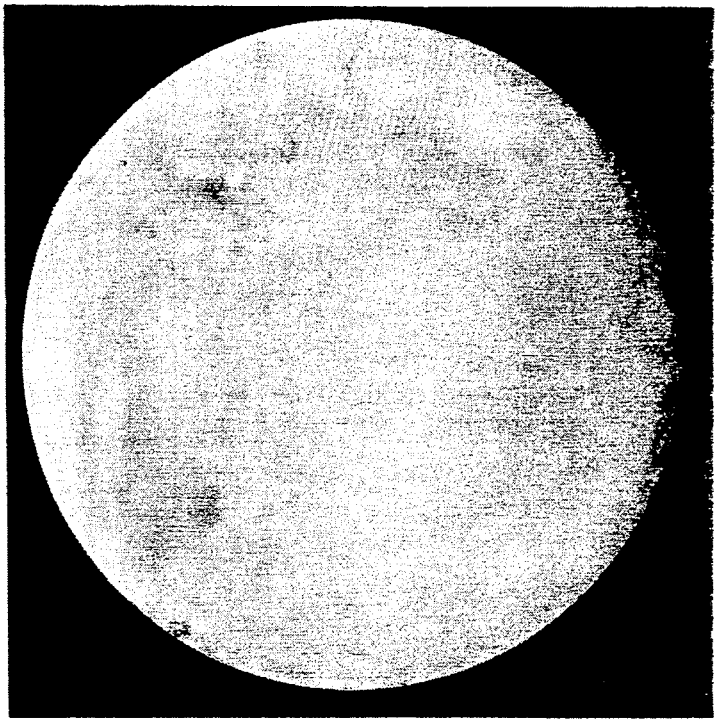
FIG. 6 is a photograph of a disk that was quenched with 0.125 inch quench cladding (stainless steel can).

A control specimen had no quench cladding. A second specimen was completely canned and hot isostatic pressed, using quench cladding about ⅛ inch (0.125 inch) thick of type 316 stainless steel. Each specimen was heated to 2180° F. in a simulated heat treatment, and then quenched in oil after a delay of 17 seconds. The unclad control specimen exhibited a widespread pattern of surface cracks, as shown in FIG. 5 (*a*), (*b*) and (*c*) at various positions of the unclad specimen. The clad specimen exhibited no surface cracking.

The present invention permits the fabrication of wrought and heat-treated superalloy articles with a reduced incidence of quench cracking that would ordinarily be found with those articles. It will be understood that various changes and modifications not specifically referred to herein may be made in the invention herein described, and to its uses herein described, without departing from the spirit of the invention particularly as defined in the following claims.

What is desired to be secured by Letters Patent follows.

What is claimed is:

1. A method for preparing a heat-treated article made of a superalloy, comprising the steps of:

furnishing an article made of a superalloy that is prone to quench cracking due to thermally induced stress;

covering at least a portion of the article with a ductile quench cladding having a sufficient thickness, so that the quench cladding is in direct thermal contact with the article;

heating the clad article to elevated temperature; and quenching the clad article from the elevated temperature to a lower temperature.

2. The method of claim 1, wherein the entire article is covered with the cladding.

3. The method of claim 1, including the additional step, after the step of furnishing but before the step of covering, of forging the article.

4. The method of claim 1, including the additional step, after the step of covering but before the step of heating, of forging the article.

5. The method of claim 1, wherein the article is a turbine disk preform.

6. The method of claim 1, wherein the article has a dual-alloy structure.

7. The method of claim 1, wherein the cladding is made of a nickel-base alloy.

8. The method of claim 1, wherein the cladding is made of an iron-base alloy.

9. The method of claim 1, wherein the cladding is made of a stainless steel.

10. The method of claim 1, wherein the step of covering includes the steps of furnishing an envelope of the quench cladding material, placing the article into the envelope, and bonding the envelope to the article.

11. The method of claim 1, wherein the step of covering includes the step of applying a coating of the cladding material onto at least a portion of the article.

12. The method of claim 1, including the additional step, after the step of quenching, of removing the quench cladding from the clad material.

13. The method of claim 1, wherein the article is made of a nickel-base superalloy.

14. The method of claim 1, wherein the quench cladding has a thickness of at least 1/16 inch.

15. The method of claim 10, wherein the step of bonding includes the step of hot isostatically pressing the envelope with the article contained therein.

16. The method of claim 11, wherein the step of applying is accomplished by a thermal spray technique.

17. A method for preparing a heat-treated superalloy turbine disk preform, comprising the steps of:

furnishing a turbine disk blank made of a nickel-base superalloy that is prone to quench cracking due to thermally induced stress;

forgoing the blank into a turbine disk preform;

covering at least a portion of the disk preform with a ductile quench cladding having a sufficient thickness, so that the quench cladding is in direct thermal contact with the disk preform;

heating the clad preform to elevated temperature;

quenching the clad preform from the elevated temperature to a lower temperature; and removing the quench cladding from the clad preform.

18. The method of claim 17 wherein the entire disk preform is covered with the quench cladding.

19. The method of claim 17, wherein a portion of the disk preform is covered with the quench cladding.

20. The method of claim 17, wherein the step of covering includes the step of applying a coating of the cladding material onto at least a portion of the disk preform.

* * * * *